United States Patent [19]

John

[11] Patent Number: 4,844,139

[45] Date of Patent: Jul. 4, 1989

[54] VERTICAL LOUVER BLIND HAVING CLUTCHED OPERATING MECHANISM

[75] Inventor: Julius F. John, Redondo Beach, Calif.

[73] Assignee: Home Fashions, Inc., Santa Monica, Calif.

[21] Appl. No.: 196,032

[22] Filed: May 19, 1988

Related U.S. Application Data

[63] Continuation-in-part of Ser. No. 102,865, Sep. 30, 1987.

[51] Int. Cl.[4] ..... E06B 9/30

[52] U.S. Cl. ..... 160/168.1; 160/178.1

[58] Field of Search ..... 160/166.1, 168.1, 178.1, 160/174

[56] References Cited

U.S. PATENT DOCUMENTS 2,898,986 8/1959 Kiefer ..... 160/168.1

*Primary Examiner*—Blair M. Johnson

*Attorney, Agent, or Firm*—Welsh & Kratz, Ltd.

[57] ABSTRACT

A venetian blind of the vertical louver type includes an elongated guide track and a plurality of louver carriers supported by the guide track for traverse between open blind and closed blind conditions. Each of the louver carriers supports a louver in generally vertical orientation for traverse with the carrier and for rotation about its longitudinal axis between open and closed louver positions. A louver operating mechanism is supported on one end of the guide track and is operative to rotate the louvers to open louver positions prior to traverse along the guide track from a closed blind condition to an open blind condition. A rotation rod extends longitudinally of the guide track in cooperative relation with the louver carriers and supports a rotation pulley actuated by a beaded chain to rotate the rotation rod and effect rotation of the louvers. A pullcord is operative to traverse the louvers along the guide track and cooperates with a spool member which is connected to the rotation pulley through a clutch arrangement such that actuation of the pullcord to traverse the louvers to an open blind condition first rotates the louvers to open louver positions. The clutch arrangement enables rotation of the rotation pulley so as to selectively rotate the louvers without actuating the spool member.

20 Claims, 2 Drawing Sheets

VERTICAL LOUVER BLIND HAVING CLUTCHED OPERATING MECHANISM

BACKGROUND OF THE INVENTION

This is a continuation-in-part from pending application Ser. No. 102,865, filed Sept. 30, 1987.

The invention relates generally to venetian blinds of the vertical louver type, and more particularly to a louver operating mechanism which insures that the louvers are in open louver positions prior to traverse of the louvers from a closed blind to an open blind condition, and which includes a novel clutch arrangement enabling 180° rotation of the blinds when in their closed blind condition.

Venetion blinds of the vertical louver type employing an elongated guide track or headrail which supports a plurality of louver carriers movable along the guide track and supporting louvers in generally vertical orientation are generally known. Such vertical louver blinds conventionally include a louver control mechanism which enables selective traverse of the louver carriers between open blind and closed blind conditions, and facilitates rotation of the louvers about their longitudinal axes between open louver positions lying in planes substantially transverse to the longitudinal axis of the guide track, and closed louver positions wherein the louvers lie in planes substantially parallel to a vertical plane containing the longitudinal axis of the track, thereby enabling selective control of the amount of light passing through the blind.

A preferred operating mode for vertical louver blinds is to rotate the vertical louvers to their open louver positions prior to traversing the louvers from closed blind to open blind conditions. If the louver carriers are caused to traverse the guide track toward an open blind condition while the louvers are in their closed louver positions lying substantially in a vertical plane containing the longitudinal axis of the guide track, the louvers may jam and cause damage to the control mechanism and/or to the louvers themselves. Accordingly, if an operator fails to rotate the louvers to their open louver positions prior to causing the louvers to traverse the guide track toward an open blind condition, substantial damage may be caused to the louvers as well as to the control mechanism. The aforementioned application Ser. No. 102,865, which is incorporated herein by reference, discloses a vertical louver blind operating mechanism which overcomes the aforedescribed problem by causing the louvers to be first moved to their open louver positions traverse to the longitudinal axis of the associated guide track prior to traversing the louvers from closed blind to open blind conditions.

When a vertical louver blind is initially installed, the louvers are initially oriented such that a selected side of the louvers always faces outwardly when in closed louver positions. If the opposite sides of the louvers are of different color or pattern, and it is desired to reverse the louvers so that the selected side faces inwardly when in closed louver position, the louver operating mechanism must be capable of enabling 180° rotation of the louvers without adversely affecting normal operation of the operating mechanism. The present invention provides such capability.

SUMMARY OF THE INVENTION

One of the primary objects of the present invention is to provide a novel louver operating mechanism for use with vertical louver type venetion blinds, the louver control mechanism being operative to rotate the louvers to open louver positions prior to traversing the louvers from closed blind to open blind conditions and being selectively operable to rotate the louvers 180° when in their closed blind condition.

A more particular object of the present invention is to provide a novel louver operating mechanism for use with a vertical louver type venetian blind having a guide track or headrail supporting a plurality of louver carriers each of which supports a louver in a generally vertical orientation. The louver carriers enable rotation of the associated louvers about their longitudinal axes and traverse of the louvers between closed and open blind conditions. A rotation rod extends longitudinally of the guide track and cooperates with the louver carriers so as to effect rotation of the louvers upon rotation of the rotation rod through a beaded-chain operated rotation pulley mounted on a control end of the rotation rod. The louver carriers are caused to traverse the guide track by a pullcord which cooperates with a spool member coupled to the rotation pulley through a slip clutch arrangement so that actuation of the pullcord to traverse the louvers from closed blind to open blind positions first automatically rotates the louvers to their open louver positions. The clutch arrangement enables the louvers to be rotated 180° when in their closed blind condition.

A feature of the louver operating mechanism in accordance with the invention lies in routing a reach of the traversing pullcord along the centerline of the spool member and generally radially outwardly therefrom such that rotation of the louvers after traversing the guide track to a closed blind condition normally causes the pullcord to be wrapped about the spool member so that subsequent actuation of the pullcord to move the louvers to an open blind condition first automatically rotates the louvers to open louver positions. The slip clutch arrangement is selectively operable to allow the rotation rod to be actuated to rotate the louvers about their longitudinal axes without wrapping the pullcord about the spool member.

Further objects, features and advantages of the invention, together with the organization and manner of operation thereof, will become apparent from the following detailed description of the invention when taken in conjunction with the accompanying drawings wherein like reference numerals designate like elements throughout the several views.

DETAILED DESCRIPTION

Figures 1, 2:
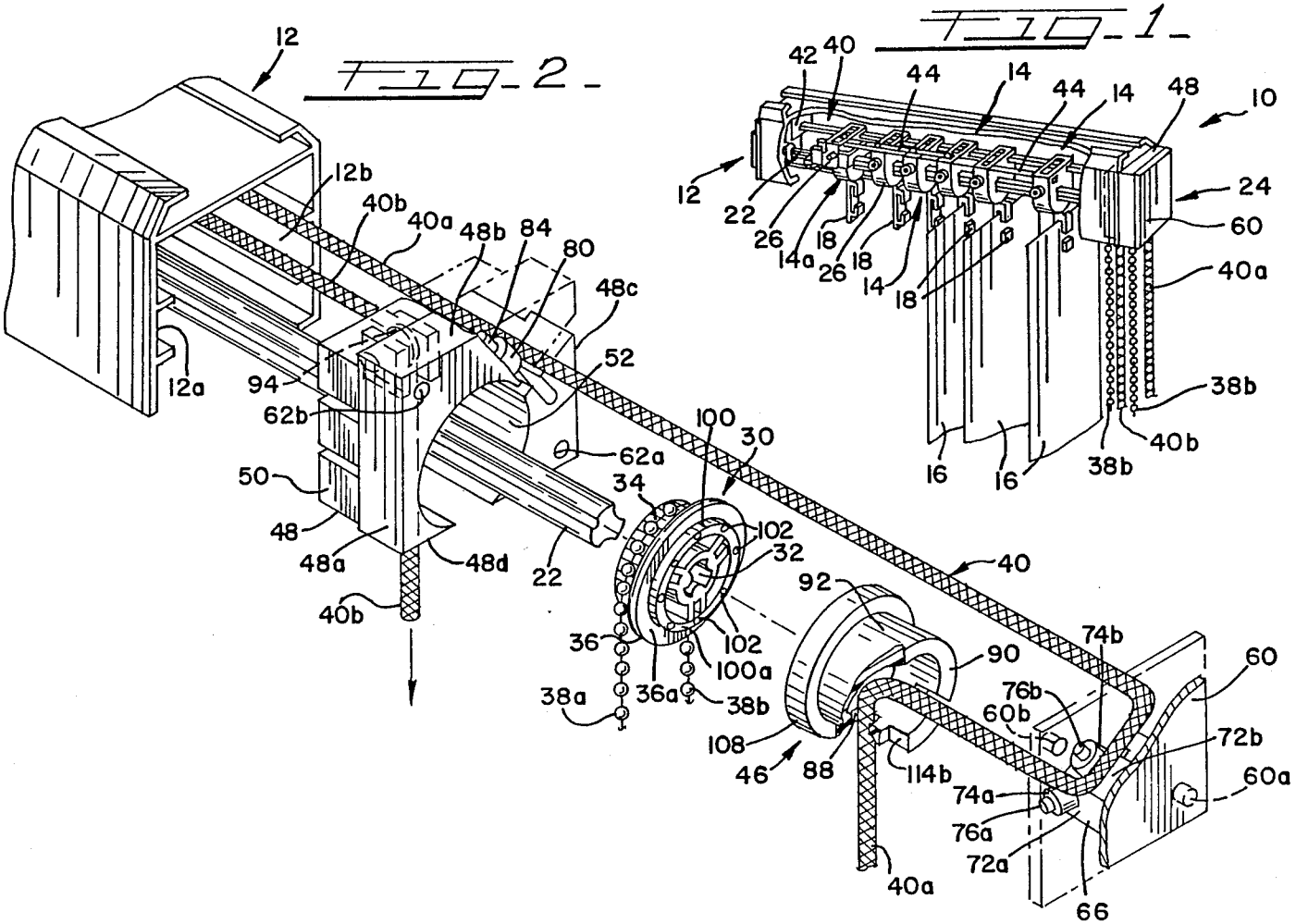
FIG. 1 is a fragmentary perspective view illustrating a vertical louver type venetian blind having a louver operating mechanism in accordance with the present invention.
FIG. 2 is an exploded fragmentary perspective view of the louver operating mechanism employed in the vertical louver venetian blind of FIG. 1.

Referring now to the drawings, FIG. 1 illustrates a venetian blind assembly, indicated generally at 10, of the vertical louver type. The venetian blind assembly 10 includes an elongated guide track or headrail, indicated generally at 12, which supports a plurality of the louver carriers or trucks 14 adapted to traverse the guide track 12 between open and closed blind conditions. Each of the louver carriers 14 releasably supports an elongated louver 16 in a generally vertical orientation through a hook-like hanger 18. The hangers 18 are rotatable about vertical axes in response to rotation of a rotation rod 22 which extends longitudinally of the guide track in cooperating relation with each of the carriers 14. Louver operating or control mechanism means indicated generally at 24, is mounted at one end of the guide track 12 and cooperates with the rotation rod 22 and louver carriers 14 to enable selective traverse of the louvers along the guide track and rotation of the louvers about their longitudinal axes.

As illustrated in FIG. 2, the guide track 12 defines a pair of laterally opposed longitudinally extending open channels or tracks **12*a* and 12*b* which receive axially aligned pairs of rollers 26 on each of louver carriers 14 so as to support the louver carriers and facilitate traverse along the guide track. EAch hanger 18 has a spur gear (not shown) formed on its upper end within the corresponding louver carrier 14 which meshes with an associated worm gear (not shown) carried within the louver carrier in a known manner. The rotation rod 22 extends through each louver carrier axially of its associated internal worm gear so as to enable traverse of the carriers along the rotation rod while being operative to effect simultaneous rotation of the hangers 18 and louvers 16 upon selective rotation of the rotation rod. To this end, the rotation rod 22 is of irregular crosssectional configuration, such as being longitudinally fluted, and is received through a similarly configured axial bore through the worm gear within each of the louver carriers 14. The louvers 16 are thus rotatable between open louver positions, wherein the louvers lie in planes substantially transverse or perpendicular to the longitudinal axis of the guide track 12 as illustrated in FIG. 1, and angled or closed louver positions wherein the louvers 16 lie in planes forming an included angle between zero (louver fully closed position) and 90° with a vertical plane containing the longitudinal axis of the guide track. In a conventional installation, the guide track 12** is generally straight and is affixed to a generally horizontal surface adjacent and parallel to a window so that the louvers may alternatively be defined as being movable between open louver positions lying in planes substantially perpendicular or normal to the corresponding window, and partially or fully closed positions wherein they lie in planes angled less than 90° to the window.

Figure 7:
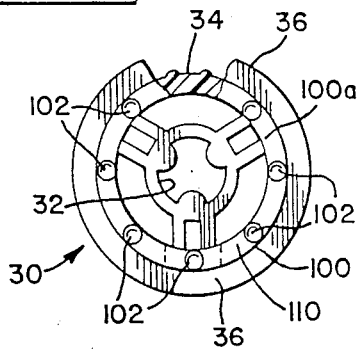
FIG. 7 is an end view of the rotation pulley illustrated in FIG. 2 but having a portion of its annular flange broken away for clarity.
Figure 8:
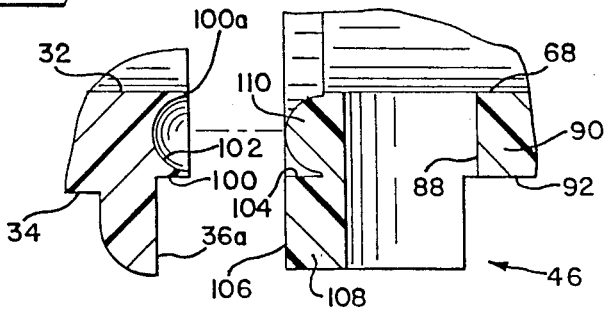
FIG. 8 is an enlarged scale fragmentary detail view illustrating a clutch detent and interfacing cooperating recess as formed on the rotation pulley and spool member.

To effect selective rotation of the rotation rod 22, the louver operating mechanism means 24 includes first actuator means in the form of a rotation pulley 30 (FIG. 2) adapted for mounting on a corresponding end of the rotation rod 22 in positive relation therewith such that rotation of the pulley 30 about its longitudinal axis is operative to effect a corresponding rotation of the rotation rod 22. As shown in FIG. 7, the rotation pulley 30 has an axial bore 32 therethrough having a transverse configuration substantially identical to the transverse configuration of the rotation rod 22 so as to snugly receive the rotation rod in positive rotationally coupled relation therewith. The rotation pulley 30 has an annular drive sprocket surface 34 formed thereon adjacent a radial flange 36. The first actuator means also includes an endless beaded chain 38 which is reeved over the sprocket surface 34 and extends downwardly from the operating mechanism means 24 so as to facilitate selective rotation of the rotation pulley and thereby the rotation rod 32 through downward pulling of either of the depending reaches **38*a* and 38*b* of the beaded chain. Thus, downward pulling on the reach 38*a* is operative to effect rotation of the louvers 16 in one rotational direction about their longitudinal axes, while downward pulling on reach 38*b*** is operative to rotate the louvers in an opposite rotational direction about their longitudinal axes.

To effect traverse of the louver carriers 14 along the guide track 12, the louver operating mechanism 24 includes second actuator means in the form of a pullcord 40 supported within the guide track and looped about an idler pulley (not shown) in an idler end cap 42 (FIG. 1) at the opposite end of the guide track from the louver operating mechanism means 24, alternatively termed the control end cap. In this manner, the pullcord defines a pair of longitudinally extending reaches **40*a* and 40*b* which pass through openings in the louver carriers. In the illustrated single panel blind, the pullcord reach 40*a* is secured to the louver carrier 14*a* farthest from the control endcap 24 such that longitudinal movement of reach 40*a* effects a corresponding traverse of the louver carrier 14*a*, termed the lead louver carrier. Conventional separation limiting means in the form of lost-motion connector bars 44 (FIG. 1) connect the successive louver carriers 14 to each other such that traverse of the lead carrier 14*a* from a position wherein the louver carriers are in an open blind condition generally adjacent the control end cap 24 to a position along the length of the guide track 12 by pulling on pullcord reach 40*b* effects a corresponding movement of each succeeding louver carrier when a predetermined distance has been attained between each louver carrier and the next successive carrier, as is known. Conversely, when the pullcord reach 40*a* is pulled to effect traverse of the lead louver carrier 14*a* toward the control end cap 24, the connector bars 44 allow the lead louver carrier 14*a* to first abut the next adjacent louver carrier and effect a corresponding movement thereof until the next adjacent louver carrier is engaged, and so on until all of the louver carriers have been moved to the open blind condition generally adjacent the control end cap 24. As aforementioned, the louver carriers 14 and associated vertical louvers 16 may be separated such that one-half of the louvers are moved to and from the idler or return end cap 42** on the guide track and the other half are simultaneously moved to and from the louver operating mechanism end of the guide track, the louvers being generally equally spaced along the length of the guide track when in a closed blind condition.

Figure 3:
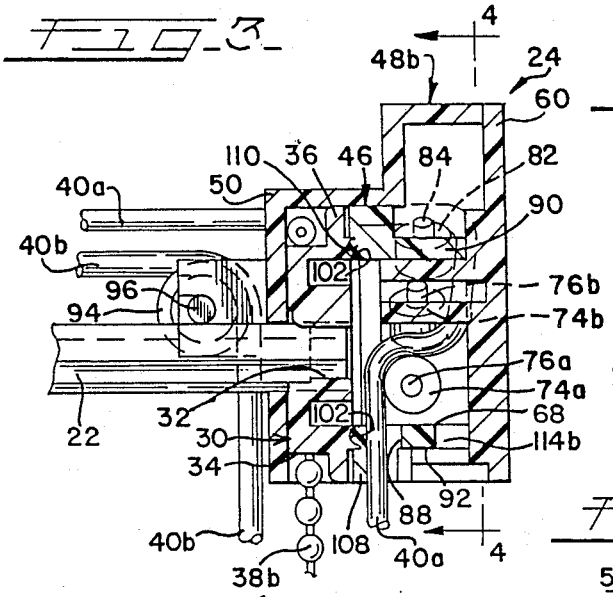
FIG. 3 is a fragmentary vertical longitudinal sectional view of the louver operating mechanism removed from the guide track or headrail.
Figure 5:
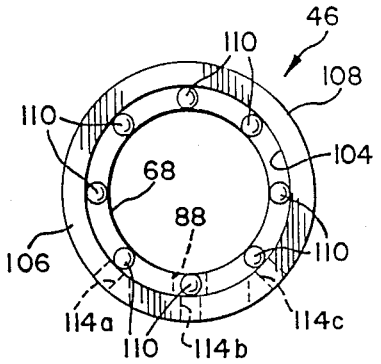
FIG. 5 is an end view of the spool member taken substantially along line 5—5 of FIG. 6.
Figure 6:
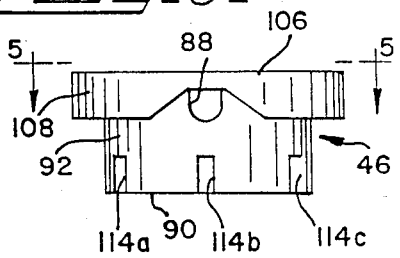
FIG. 6 is a bottom view of the spool member of FIG. 5.
Figure 4:
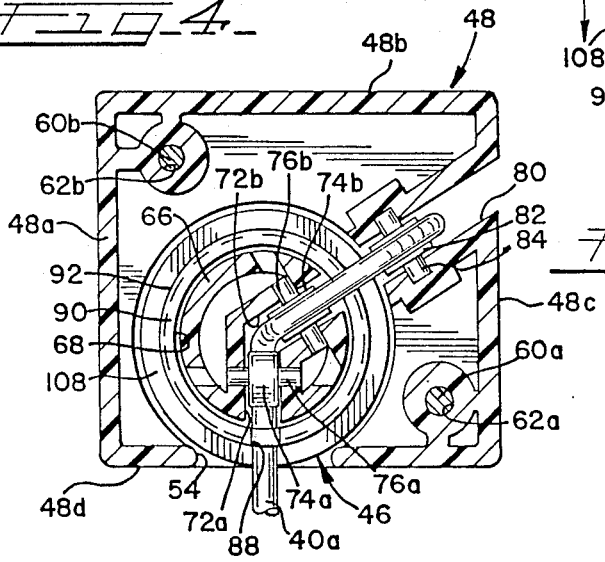
FIG. 4 is a transverse sectional view taken substantially along line 4—4 of FIG. 3.

The pullcord 40 of the second actuator means is operatively associated with a spool member 46 which is coupled to the rotation pulley 30 of the first actuator means through a slip clutch arrangement such that actuation of the pullcord to traverse the louvers 16 from a closed blind condition to an open blind condition normally first effects rotation of the louvers to their open louver positions lying in planes substantially transverse to the longitudinal axis of the guide track. Referring to FIGS. 2–4, the louver operating mechanism 24 includes an endcap housing 48 having a rectangular external configuration such that its external wall surfaces 48*a–d* are substantially coplanar with corresponding outer wall surfaces of the guide track 12 when a reduced size rectangular end 50 of the endcap is mounted within an open end of the guide track. The endcap housing 48 may be made of a suitable plastic material and has a generally cylindrical bore 52 formed longitudinally therein which receives the rotation pulley 30 when mounted on an end of the rotation rod 22 extending into the bore 52 through a circular opening 50*a* in the endcap housing. The bore 52 intersects the lower surface 48*d* of the encap housing to define a rectangular opening 54 which intersects a generally rectangular opening 56 formed upwardly from the lower surface of the reduced end 50.

A rectangular cover plate 60 is adapted for mounted on the outer end of the endcap housing 49 through a pair of pilot pins 60*a* and 60*b* projecting from the cover plate and received within bores 62*a* and 62*b* formed in the endcap housing to establish predetermined orientation of the cover plate 60 on the endcap housing. The cover plate 60 may also be made of a suitable plastic material and has a generally cylindrical boss 66 adapted to be received within a cylindrical bore 68 formed axially of the spool member 46. The boss 66 has an outer diameter sized to enable rotation of spool member 46 within the bore 52 of the endcap housing 48.

As illustrated in FIG. 4, a pair of radial intersecting slots or recesses 72*a* and 72*b* are formed in the boss 66 to receive rotatable pulleys 74*a* and 74*b* which are mounted, respectively, on support shafts 76a and 76b. The pulleys 74*a* and 74*b* serve to guide the reach 40*a* of pullcord 40 into the bore 68 in the spool member 46 along its rotational axis. The reach 40*a* of the pullcord which extends longitudinally within the guide track 12 from the idler end cap 42 is passed through a slot or recess 80 formed in the endcap housing 48 and reeved about a pulley 82 rotatably supported on a support shaft 84 within slot 74*a* and 74*b* after which its passes radially outwardly through a radial opening 88 formed in an annular wall 90 of the spool member 46 which defines the internal bore 68. With the pullcord reach 40*a* extending generally radially through the opening 88, rotation of the spool member 46 causes the pullcord to be wrapped about an outer surface 92 on the annular wall 90. If desired, the surface 92 may be formed with a spiral fluting to better assure that the pullcord will wrap about the spool member in spiral fashion.

The reach 40*b* of pullcord 40 which extends longitudinally of the guide track 12 from the idler end cap 42 is passed about a pulley 94 rotatably supported on a substantially horizontal support shaft 96 between a pair of spaced walls 98*a* and 98*b* extending outwardly from the end 50 of endcap housing 48. The pullcord reach 40*b* passes over pulley 94 and downwardly generally parallel to the depending pullcord reach 40*a*.

In the operation of the vertical louver blind assembly thus far described, and assuming a condition wherein the vertical louvers 16 and associated louver carriers 14 are in an open blind condition disposed generally adjacent the control end of the guide track 12, and further assuming that the louvers 16 are disposed in planes substantially transverse or perpendicular to the longitudinal axis of the guide track 12, the spool member 46 will be rotationally positioned such that the radial opening 88 is exposed through the opening 54 in housing 48 and the reach 40*b* of the pullcord extends radially downwardly from the rotational axis of the spool member. In this condition, downward pulling on the pullcord reach 40*b* will cause the louver carriers to traverse the guide track toward a closed blind condition. The separation limiting bars 42 effect substantially equal spacing between the louvers along the guide track when the lead louver carrier 14*a* has traversed substantially the full length of the guide track. With the louvers 16 disposed in a closed blind condition, rotation of the louvers about their vertical longitudinal axes may be effected by pulling on either of the reaches 38*a* or 38*b* of the pull chain 38 to effect selective directional rotation of the rotation pulley 30 and rotation rod 22. In this manner the louvers 16 may be rotated in either rotational direction about their longitudinal axes between open louver positions lying in planes transverse to the longitudinal axis of the guide track and closed louver positions wherein the louvers lie in planes substantially parallel to a vertical plane containing the longitudinal axis of the guide track.

As aforementioned, the spool member 46 is coupled to the rotation pulley 30 through a slip clutch arrangement such that rotation of the pulley by means of the beaded chain 38 to rotate the louvers 16 about their longitudinal axes normally causes the spool member to undergo a corresponding rotation. Such rotation of the spool member 46 causes the pullcord 40 to be wrapped about the peripheral surface 92 on the spool member. When it is desired to traverse the louvers 16 from their closed blind to open blind conditions, downward pulling of the depending pullcord reach 40*a* causes the spool member 46 to be rotated in a direction opposite to the direction of rotation which initially caused the pullcord to be wrapped about the spool, until the portion of the pullcord which had previously been wrapped about the spool member is unwrapped and again extends radially downward from the spool member. Such reverse rotation of the spool member during unwrapping of the pullcord causes the rotation pulley 30 to undergo a corresponding rotation which effects automatic return of the louvers to their open louver positions. Thereafter further downward pulling on reach 48*a* of the pullcord causes traverse of the louver carriers 14 and associated louvers 16 to their open blind condition. In this manner, movement of the pullcord 40 in a direction to traverse the louvers to an open blind condition normally first automatically rotates the louvers 16 to open louver positions, thus preventing traverse of the louvers 16 to an open blind condition while in closed louver positions which could cause damage to the louvers and/or the louver control mechanism means.

The slip clutch arrangement coupling the spool member 46 and rotation pulley 30 enables selective actuation of the pull chain 38 so as to rotate the louvers 16 through the rotation rod 22 without effecting a corresponding rotation of the spool member 46, thus enabling 180° rotation of the louvers about their longitudinal axes so as to reverse the surfaces of the louvers which face outwardly when the louvers are in their closed louver conditions lying substantially in a vertical plane containing the longitudinal axis of the guide track. Referring to FIGS. 2 and 3, taken in conjunction with FIGS.

5–8, the rotation pulley 30 has an annular flange 100 formed integral therewith which extends outwardly from the planar surface 36*a* on the radial flange 36. The annular flange 100 has a planar annular end surface 100*a* in which is formed a plurality of circumferentially equidistantly spaced generally semi-spherical recesses 102. The flange 100 is adapted to be received within an annular recess 104 formed in a planar surface 106 on an annular flange 108 on spool member 46 such that the recesses 102 mate or couple with a corresponding number of semi-spherical drive projections 110 formed in recess 104.

The axial lengths of the rotation pulley 30 and spool member 46 are such that when the rotation pulley is mounted on an end of the rotation rod 22 within the endcap housing bore 52, and the spool member is mounted on the cylindrical boss 66 within the endcap housing 48, the drive projections 110 on the spool member couple with the recesses 101 in the rotation pulley to normally effect corresponding rotation of both the rotation pulley and spool member upon rotation of either of them. The spool member and rotation pulley are preferably made of a plastic material having sufficient resiliency to enable slipping therebetween at the interfaces of the recesses 102 and drive projections 110 so as to allow selective rotation of the rotation pulley when rotation of the spool member relative to the endcap housing is prevented.

To prevent rotation of the spool member 46 when it is desired to rotate the louvers without having the pullcord 40 wrap about the spool member, a plurality of radial slots 114*a,b* and *c* are formed in the annular wall 90 of the spool member to intersect its outer surface 92. The radial slots 114*a,b* and *c* are accessible through the access opening 54 in the lower surface of the endcap housing 48 and enable a tool, such as the end of a screwdriver, to be inserted upwardly into one of the radial slots for preventing rotation of the spool member while the beaded chain 38 is operated to rotate the rotation pulley and effect rotation of louvers 16 about their longitudinal axes. In this manner, the rotation pulley 30 may be rotated to rotate the louvers 180° about their longitudinal axes when in their closed blind condition without causing the pullcord 40 to be wound or wrapped about the spool surface 92. This enables the radial spacing between the annular spool surface 92 and the bore surface 52 to be minimized, and also enables selective 180° rotation of the louvers without inhibiting the normal function of the louver operating mechanism in effecting rotation of the louvers to positions transverse to the longitudinal axis of the guide track 12 prior to traverse to an open blind condition adjacent one or both ends of the guide track upon actuation of the pullcord 40. It will be appreciated that the drive projections 110 could be formed on the rotation pulley 30, and the coupling recesses 102 formed in the spool member 46.

Thus, in accordance with the present invention, a venetion blind assembly of the vertical louver type is provided which is of relatively simple construction and which employs a louver operating mechanism operative to automatically rotate the louvers to full open louver positions lying in planes substantially transverse to the longitudinal axis of the guide track prior to traversing the louvers along the guide track from a closed blind to an open blind condition, while enabling selective 180° rotation of the louvers about their longitudinal axes when in a closed blind condition.

While a preferred embodiment of the invention has been illustrated and described, it will be understood that changes and modifications may be made therein without departing from the invention in its broader aspects. For example, the beaded chain and pullcord normally operative to effect, respectively, rotation of the louvers about their longitudinal axes and traverse along the guide track, may comprise alternative types of chains or pullcords which facilitate operation of the rotation pulley and spool member of louver operating mechanism. Various features of the invention are defined in the following claims.

What is claimed is:

1. A louver operating mechanism for use in a venetian blind assembly of the vertical louver type having an elongated guide track, at least one louver carrier adapted to traverse said guide track and having means adapted to support a louver in a generally vertical orientation for rotation about its longitudinal axis, and a rotation rod extending longitudinally of said guide track and having cooperation with said louver carrier in a manner to effect rotation of the associated louver about its longitudinal axis between an open louver position and a closed louver position upon selective rotation of said rotation rod, said louver operating mechanism being adapted for mounting adjacent the guide rail and comprising first actuator means including a rotation member coupled to said rotation rod so as to effect rotation of said rod upon rotation of said rotation member, said louver operating mechanism further including second actuator mean shaving a pullcord operatively associated with said louver carrier in a manner enabling selective traverse of said louver carrier along said guide track between open and closed blind conditions, said second actuator means further including a spool member coaxial with said rotation member and defining slip clutch therebetween, said spool member being cooperative with said pullcord such that actuation of said pullcord to traverse said louver from a closed blind to an open blind condition normally first effects rotation of said rotation member to rotate said louver to its open louver position, said slip clutch enabling rotation of said rotation member to rotate said louver about its longitudinal axis independently of said spool member.

2. A louver operating mechanism as defined in claim 1 wherein said rotation member comprises a rotation pulley mounted coaxially on said rotation rod in positive rotational relation therewith, and control chain means cooperative with said rotation pulley so as to enable selective rotation thereof to selectively rotate said rotation rod.

3. A louver operating mechanism as defined in claim 2 wherein said rotation pulley defines an external sprocket surface engaged by said control chain means such that longitudinal movement of said chain means effects rotation of said rotation pulley, said second actuator means including a pullcord extending longitudinally of said guide track in cooperative relation with said louver carrier so as to facilitate traverse of said carrier along said guide track in response to longitudinal movement of said pullcord, said pullcord being guided along the rotational axis of said spool member and extending outwardly therefrom such that rotation of said spool member when rotating said rotation rod normally causes said pullcord to be wrapped about said spool member.

4. A louver operating mechanism as defined in claim 1 including an endcap housing adapted to be mounted on an end of said guide track and receive said rotation rod therein, said rotation member being received within said endcap housing and mounted on said rotation rod so as to effect rotation of said rotation rod upon rotation of said rotation member, said pullcord being cooperative with said spool member so as to be normally wrapped about said spool member upon rotation of said rotation member such that longitudinal movement of said pullcord in a direction to effect traverse of said louver carrier from a closed to an open blind condition first effects rotation of said rotation member to rotate said louver to an open louver position.

5. A louver operating mechanism as defined in claim 4 wherein said pullcord defines a reach extending longitudinally of said guide track said endcap housing including guide means operative to guide said pullcord along the rotational axis of said spool member, and said spool member being adapted to guide said pullcord outwardly therefrom.

6. A louver operating mechanism as defined in claim 2 wherein the venetion blind assembly includes a plurality of said louver carriers supported by and adapted to traverse said guide track, each of said louver carriers being cooperative with said rotation rod and supporting a vertical louver for rotation about its longitudinal axis upon rotation of said rotation rod, said rotation pulley being positively coupled to said rotation so as to effect simultaneous rotation of said louvers upon rotation of said rotation pulley.

7. A louver operating mechanism as defined in claim 6 including means operative to guide said pullcord along the rotational axis of said spool member and generally radially outwardly therefrom such that rotation of said rotation rod causes said pullcord to be wrapped about said spool member so that actuation of said pullcord to traverse said louvers to an open blind condition first rotates said louvers to open louver positions.

8. A louver operating mechanism as defined in claim 1 wherein said rotation member and spool member are supported in axially aligned interfacing relation, said slip clutch including a plurality of drive projections formed on a selected one of said rotation member and spool member, and a corresponding number of recesses formed on the other of said rotation member and spool member, said drive projections and recesses being adapted for releasable coupled relation so as to enable simultaneous rotation of said rotation member and spool member or enable rotation of the selected one of them.

9. A louver operating mechanism as defined in claim 8 wherein said spool member includes rotation restriction means accessible from externally of said operating mechanism to prevent rotation of said spool member during rotation of the said rotation pulley.

10. A venetian blind assembly of the vertical louver type comprising, in combination, an elongated guide track, a plurality of louver carriers supported by said guide track for traverse longitudinally thereof, a louver supported by each of said louver carriers in generally vertical orientation for rotation about its longitudinal axis and movement with said carrier between open blind and closed blind conditions, a rotation rod extending longitudinally of said guide track and cooperative with said louver carriers in a manner to effect rotation of said louvers about their longitudinal axes upon rotation of said rotation rod, first actuator means including a rotation member cooperative with said rotation rod in a manner enabling selective rotation of said rotation rod so as to rotate said louvers between open louver and closed louver positions in response to rotation of said rotation member, second actuator means including a pullcord cooperative with said louver carriers to enable selective traverse of said louvers between said open blind and closed blind conditions, and a spool member coaxial with said rotation member and defining a slip clutch therebetween, said spool member being cooperative with said pullcord such that actuation of said pullcord to traverse said louvers from closed blind to open blind conditions normally first effects rotation of said louvers to open louver positions, said slip clutch enabling selective rotation of said rotation member to rotate said louvers independently of said spool member.

11. A venetian blind assembly as defined in claim 10 wherein said rotation member comprises a rotation pulley mounted coaxially on said rotation rod in positive rotational relation therewith, and control chain means cooperative with said rotation pulley so as to enable selective rotation thereof to selectively rotate said rotation rod.

12. A venetian blind assembly as defined in claim 11 wherein said rotation pulley defines an external sprocket surface engaged by said control chain means such that longitudinal movement of said chain means effects rotation of said rotation pulley, said pullcord extending longitudinally of said guide track in cooperative relation with said louver carriers so as to facilitate traverse of said carriers along said guide track in response to longitudinal movement of said pullcord, said pullcord being guided along a rotational axis of said spool member and extending outwardly therefrom such that rotation of said rotation pulley to rotate said rotation rod normally causes said pullcord to be wrapped about said spool member, said slip clutch enabling selective rotation of said rotation pulley without effecting rotation of said spool member.

13. A venetion blind assembly as defined in claim 11 including an endcap housing adapted to be mounted on an end of said guide track and receive said rotation rod therein, said rotation pulley being received within said endcap housing and mounted on said rotation rod so as to effect rotation of said rotation rod upon rotation of said rotation pulley, said pullcord being normally wrapped about said spool member upon rotation of said rotation pulley such that longitudinal movement of said pullcord in a direction to effect traverse of said louver carriers from closed blind to open blind conditions first effects rotation of said louvers to open louver positions, said slip clutch enabling selective rotation of said rotation pulley without effecting rotation of said pulley member.

14. A venetian blind assembly as defined in claim 13 wherein said pullcord defines a reach extending longitudinally of said guide track, said endcap housing including guide means operative to guide said pullcord along the rotational axis of said spool member, said spool member being operative to guide said pullcord generally radially outwardly therefrom.

15. A venetian blind assembly as defined in claim 10 wherein said slip clutch is defined by a plurality of drive projections and recesses formed on interfacing surfaces of said rotation member and spool member, said drive projections and recesses normally being in coupled relation so as to effect simultaneous corresponding rotation of said rotation member and spool member upon selective rotation of either of them, said coupled drive projections and recesses being releasable to enable rotation of rotation member without rotating said spool member.

16. A venetian blind assembly as defined in claim 15 wherein said spool member includes means enabling selective prevention of rotation thereof.

17. A venetian blind assembly as defined in claim 16 wherein said rotation prevention means includes a plurality of slots formed in said spool member so as to enable insertion of a rotation preventing tool.

18. A louver operating mechanism as defined in claim 1 wherein said spool member includes rotation restriction means accessible from externally of said operating mechanism to prevent rotation of said spool member during rotation of said rotation pulley.

19. A louver operating mechanism as defined in claim 18 wherein said rotation prevention means includes a plurality of slots formed in said spool member so as to enable insertion of a rotation preventing tool from externally of said operating mechanism.

20. A louver operating mechanism as defined in claim 4 wherein said endcap includes means for supporting said rotation member about an axis coincident with the axis of rotation of said rotation rod.

* * * * *

UNITED STATES PATENT AND TRADEMARK OFFICE

CERTIFICATE OF CORRECTION

PATENT NO. : 4,844,139

DATED : July 4, 1989

INVENTOR(S) : Julius F. John

It is certified that error appears in the above-identified patent and that said Letters Patent is hereby corrected as shown below:

In the Specification:

Column 1, line 16, "Venetion" should be --Venetian--.

Column 1, line 51, "traverse" should be --transverse--.

Column 2, line 1, "venetion" should be --venetian--.

Column 3, line 34, "EAch should be --Each--.

Column 3, line 44, "crosssectional" should be --cross-sectional--.

Column 5, line 23, "mounted" should be --mounting--.

Column 5, line 24, "49" should be --48--.

Column 5, line 46, "84 within slot 74a and 74b after which..." should read --84 within slot 80. The pullcord is passed about pulley 82 and about the pulleys 74a and 74b after which--.

Column 6, line 29, "pulley" should be --rotation pulley--.

Column 7, line 19, "recesses 101" should be --recesses 102--.

Column 7, line 59, "vention" should be --venetian--.

UNITED STATES PATENT AND TRADEMARK OFFICE

CERTIFICATE OF CORRECTION

PATENT NO. : 4,844,139

DATED : July 4, 1989

INVENTOR(S) : Julius F. John

It is certified that error appears in the above-identified patent and that said Letters Patent is hereby corrected as shown below:

In the Claims:

Column 8, line 31, "mean shaving" should read --means having--.

Column 8, line 36, "defining slip" should read --defining a slip--.

Column 9, line 15, "track said" should read --track, said--.

Column 9, line 21, "venetion" should read --venetian--.

Column 9, line 27, "rotation so" should read --rotation rod so--.

Column 10, line 38, "vention" should be --venetian--.

Column 12, line 9, "endcap includes" should be --endcap housing includes--.

Signed and Sealed this

Seventh Day of August, 1990

*Attest:*

HARRY F. MANBECK, JR.

*Attesting Officer*

*Commissioner of Patents and Trademarks*